United States Patent [19]

Simonsson

[11] 4,360,948

[45] Nov. 30, 1982

[54] VACUUM CLEANER NOZZLE ARRANGEMENT

[75] Inventor: Sven B. Simonsson, Tyreso, Sweden

[73] Assignee: Aktiebolaget Electrolux, Stockholm, Sweden

[21] Appl. No.: 199,850

[22] Filed: Oct. 23, 1980

[30] Foreign Application Priority Data

Oct. 4, 1979 [SE] Sweden ..... 7908216

[51] Int. Cl.[3] ..... A47L 9/06

[52] U.S. Cl. ..... 15/373

[58] Field of Search ..... 15/368, 371, 373

[56] References Cited

U.S. PATENT DOCUMENTS

| | | | |
|---|---|---|---|
| 2,597,808 | 5/1952 | McQuilkin | 15/373 |
| 3,727,263 | 4/1973 | Johansson | 15/373 |
| 4,073,031 | 2/1978 | Schwartz | 15/373 |

*Primary Examiner*—Chris K. Moore

*Attorney, Agent, or Firm*—Alfred E. Miller

[57] ABSTRACT

A vacuum cleaning nozzle consists of only two parts, i.e. a flat surface nozzle and a brush nozzle, which alternatively can be brought into contact with a work surface. The flat surface nozzle is provided with a casing for introducing of a pipe piece for the attachment of the nozzle to a suction hose, and both nozzles are lockable to each other by a locking member which is inserted between the brush nozzle and the casing.

6 Claims, 8 Drawing Figures

VACUUM CLEANER NOZZLE ARRANGEMENT

The present invention relates to a vacuum cleaner nozzle for a suction hose having two movable working members, which are a brush nozzle and a flat surface nozzle. Either the brush nozzle or the flat surface nozzle alternatively can be brought into contact with a work surface by means of a switching mechanism by its moving between two end positions.

Vacuum cleaner nozzles are known which have a housing enclosing both working members, one of the working members being firmly attached by means of screws or other fastening means to the housing, and the other working member being movably arranged in relation to the first working member.

The housing in a nozzle construction is a component which increases the cost of the nozzle due to material and manufacturing costs. In addition, the weight of the nozzle is increased, thus causing the nozzle to be more bulky and difficult to use, for example, under low furniture. Moreover, fastening means such as screws and similar articles increase the cost of assembly of the nozzle.

An object of the present invention is to eliminate the above drawbacks and to obtain a vacuum cleaner nozzle consisting of only two parts, i.e. the working members themselves. For this purpose the invention is characterized essentially in that the flat surface nozzle on its upper portion has a casing for attaching of a pipe piece that is connected to a suction conduit and is detachably connected to the brush nozzle by means of a locking member, inserted between the brush nozzle and the casing.

In order that the invention will be more clearly understood, it will now be disclosed in greater detail with reference to the accompanying drawings, in which.

Figure 8:
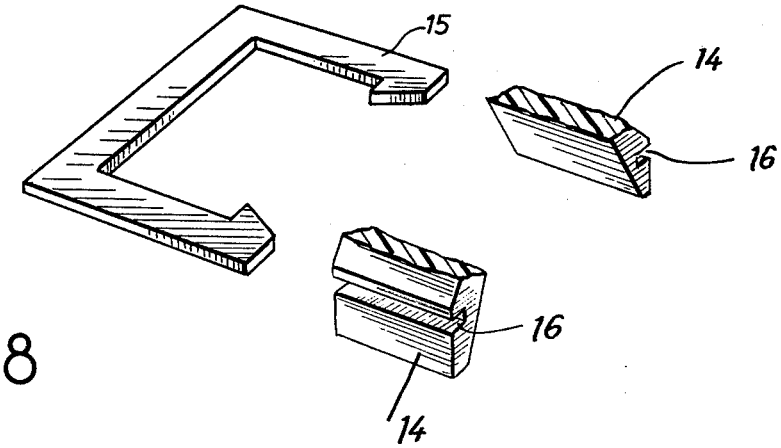
FIG. 8 is a perspective view of the locking member between the flat surface nozzle and the brush nozzle together with a slot in the casing into which the nozzle member is inserted.

The nozzle is referred to generally by the reference numeral 10 and consists of a brush nozzle 11, and a flat surface nozzle 12. The nozzle is attachable to a suction hose, (not shown) by means of a pipe piece 13. The pipe piece 13 is rotatably mounted in a casing 14 mounted on the flat surface nozzle 12. The flat surface nozzle 12 is detachably connected to the brush nozzle 11 by means of a locking device 15, which is adapted to be mounted on the casing 14. The casing 14 has in its envelope surface two oppositely located, spaced confronting grooves 16 into which the locking member 15 can be inserted. As shown in FIG. 8, the locking member can take the shape of a U-shaped body with its legs entering the corresponding grooves 16.

A switching means or mechanism 17 being a U-shaped yoke is, by its legs 18, pivotally mounted in notches 20 shaped on the top portion of the brush nozzle 11 for lifting of the flat surface nozzle 12 from the work surface by applying a pressure on a portion 19 connecting the legs 18. In addition, a return member 21 is connected to the switching mechanism 17 by means of which the flat surface nozzle can be returned into contact with the surface. In the latter position the flat surface nozzle is held by means of compression springs 27.

Figure 1:
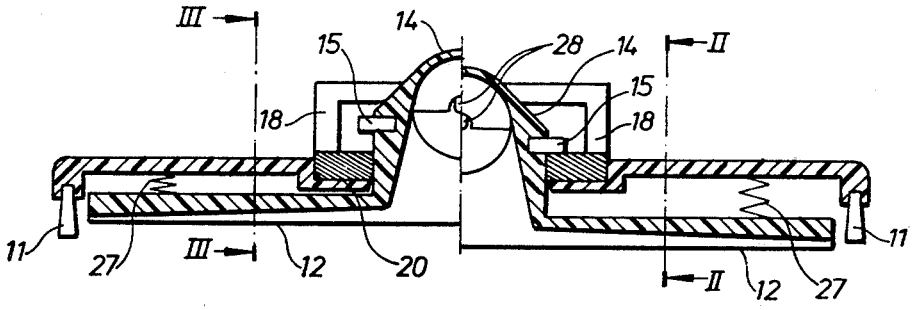
FIG. 1 is a longitudinal section through the nozzle taken along the lines I—I in FIG. 2 wherein its right half portion shows the flat surface nozzle in its working position and its left half portion shows the same nozzle in its idle position.
Figure 4:
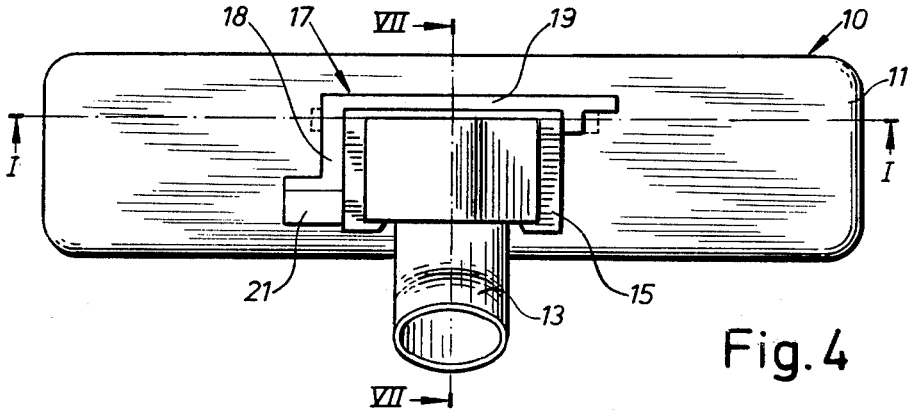
FIG. 4 is a top plan view of the nozzle.
Figure 2:
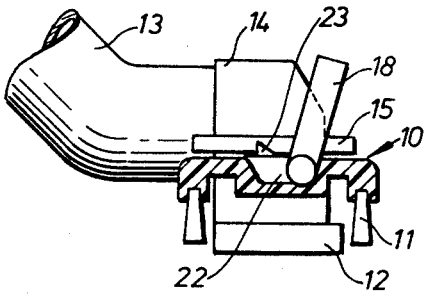
FIGS. 2 and 3 show the positions of FIG. 1 in a cross section taken along the lines II—II and III—III in FIG. 1.
Figure 3:
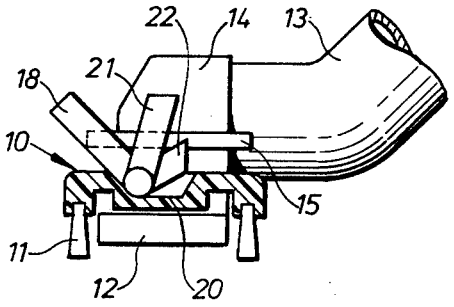
Figure 5:
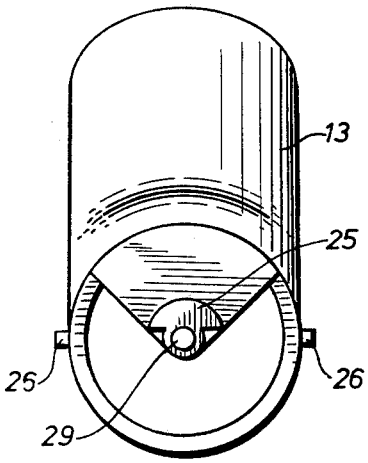
FIG. 5 is a front perspective view of the pipe piece for attachment of the nozzle to a suction hose.

Blocking members 22 are secured to the legs 18 of the switching mechanism 17 at an angle thereto; said members being shown in their idle positions in FIG. 2, i.e. while the flat surface nozzle is in its working position or at rest in notches 20, where they are fixed by the locking member 15 that is secured thereabove in grooves 16. On the underside of the locking member 15, cooperating means in the form of recesses 23 are shaped for locking of the blocking member 22 while the flat surface nozzle 12 is in its upper position, i.e., in its idle position as shown in FIG. 3.

Figure 6:
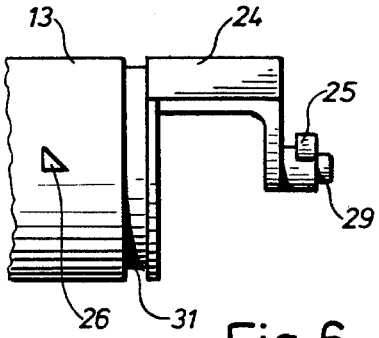
FIG. 6 is a side elevational view of the pipe piece.
Figure 7:
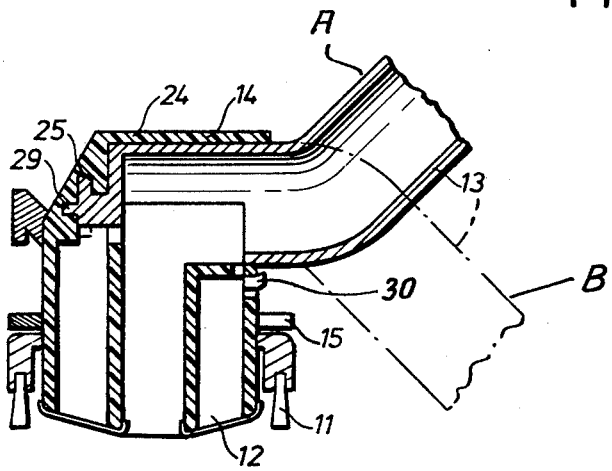
FIG. 7 is a cross-sectional view through the nozzle casing and the pipe piece.

The pipe piece has at its end towards the nozzle a shovel-shaped portion 24, which lies over the suction opening of the casing 14, and in its front part supporting a key-shaped member 25 for axial locking of the pipe piece within the casing. As evident from FIG. 7, the casing in its upper position is double-walled, and has a depression 28 for insertion of a bearing pivot 29. On its outside surface the pipe piece 13 has stop members 26, as seen in FIG. 6 for limiting of its turning motion within the casing 14 and a circular groove 31 for a seal (not shown). Furthermore, a resilient stop member 30 in the shape of an axial elevation is mounted in the lower part of the casing 14.

The nozzle embodying the present invention is described as follows: The brush nozzle 11 is located above the flat surface nozzle 12 while the switching mechanism 17 is inserted in notches 20 on the upper side of the brush nozzle. The locking member 15 is slid into grooves 16 in the side portions of the casing 14. The pipe piece 13 is attached to the casing 14 in the position marked B in FIG. 7, and is rotated thereafter into position A. As evident from FIG. 6, the stop members 26 have a triangular shape, with one side slanting against the turning movement so that during turning or pivoting of the pipe piece counter-clockwise from position B to position A the resilient stop member 30, due to its resiliency, allows this movement, but thereafter prevents the pipe piece from being turned in a clockwise direction to position B. However, the pipe piece can be turned or pivoted $\pm 90°$, from an imaginary plane drawn perpendicular to the work surface, which is sufficient for adjusting the nozzle.

During the vacuum cleaning of a carpet, the switching mechanism 17 and the flat surface nozzle 12 are in the position shown in FIG. 2. When cleaning a hard floor, such as wood or tile, the portion 19 of the switching mechanism 17 is pressed downwardly causing the blocking members 22 to be swung upwardly until they are locked in recesses 23. During this movement the locking member 15, and also the casing 14 and the flat surface nozzle 12, are lifted against the force of springs 27 to their upper position, as seen in FIG. 3. If it is desired to return the flat surface nozzle to its working position, the return member 21 is pressed downward and the blocking members 22 are freed from recesses 23, while springs 27 return the flat surface nozzle to its outer position on the work surface, as seen in FIG. 2.

The nozzle, according to the present invention, comprises fewer details than other known devices of this type, which simplifies and decreases the cost both of the manufacture and assembly of the nozzle. It should be noted that fastening components of the screw or rivet type are not present, which makes possible the automatic assembly of nozzles, which also decreases manufacturing costs.

The invention is, of course, not limited to the above-described and shown embodiment, but several modifications are possible within the spirit and scope of the invention as evident from the following claims.

What is claimed is:

1. A vacuum nozzle adapted for use on a working surface comprising two relatively movable working members consisting of a brush nozzle and a flat surface nozzle, a spring positioned between and attaching said flat surface nozzle to said brush nozzle, said spring acting to push said flat surface nozzle and said brush nozzle apart, said brush nozzle being provided with a housing, a switching means which, when moved between the two end positions thereof, alternately brings either said brush nozzle or said flat surface nozzle into contact with the working surface, a pipe piece, a suction hose which is operatively connected to said vacuum cleaner nozzle by means of said pipe piece whereby the brush nozzle surrounds said flat surface nozzle and has a substantially central aperture in its upper surface, a casing on the upper part of said flat surface nozzle projecting through said aperture, said pipe piece being pivotally mounted in said casing, and a locking member being removably mounted on the surface of said casing, said switching means being held in operating condition between said brush nozzle housing and said locking member, said switching means acting to move said flat surface nozzle against the force of said spring and cooperating with corresponding cooperating means on said locking member so that said flat surface nozzle is locked in its working position.

2. A nozzle as claimed in claim 1 wherein said casing on its surface has two opposite, space confronting grooves wherein said locking member is inserted.

3. A nozzle as claimed in claim 2 wherein said locking member is U-shaped and its legs are lockable in said grooves.

4. A nozzle as claimed in claim 1 wherein said switching means is in the form of a U-shaped yoke, and said brush nozzle is further provided with notches on the upper side thereof wherein the legs of said U-shaped yoke are rotatably mounted; said legs of said yoke each having a blocking member mounted on the free end thereof at an angle thereto sufficient to cause the blocking members to engage said cooperating means of said locking member to lift the flat surface nozzle from the work surface by applying pressure on the portion of said yoke connecting said legs.

5. A nozzle as claimed in claim 4 wherein said blocking members are held in position inside said notches by means of said locking member.

6. A nozzle as claimed in claim 5 wherein said cooperating means on said locking member comprise at least one recess on the underside of said locking member for locking of at least one of said blocking members when said flat surface nozzle is in its lifted position.

* * * * *